US006162049A

United States Patent [19]

Pellizzari et al.

[11] Patent Number: 6,162,049

[45] Date of Patent: Dec. 19, 2000

[54] PREMIXED IONIZATION MODULATED EXTENDABLE BURNER

[75] Inventors: Roberto O. Pellizzari, Groton; Johannes H. J. Thijssen; Scott Macadam, both of Cambridge, all of Mass.

[73] Assignee: Gas Research Institute, Chicago, Ill.

[21] Appl. No.: 09/263,012

[22] Filed: Mar. 5, 1999

[51] Int. Cl.[7] ..... F23D 3/40

[52] U.S. Cl. ..... 431/326; 431/186; 431/189; 431/350; 431/188; 239/562; 239/417.3; 60/749

[58] Field of Search ..... 431/326, 328, 431/186, 189, 154, 155, 350, 353, 331, 2, 354, 348, 188, 12; 239/562, 563, 417.3; 60/734, 749, 740, 722

[56] References Cited

U.S. PATENT DOCUMENTS

| | | | |
|---|---|---|---|
| 1,482,258 | 1/1924 | Reed | 431/186 |
| 1,638,498 | 8/1927 | McNutt | 431/328 |
| 1,878,427 | 9/1932 | Ronstrom | 431/186 |
| 2,306,467 | 12/1942 | Reynolds | 431/331 |
| 3,283,802 | 11/1966 | Farnham | 431/186 |
| 3,822,110 | 7/1974 | Paredes et al. | 431/186 |
| 4,408,984 | 10/1983 | Forster | 431/353 |
| 4,755,136 | 7/1988 | Gotte | 431/354 |
| 4,960,378 | 10/1990 | Jannemann et al. | 431/114 |
| 5,203,689 | 4/1993 | Duggan et al. | 431/114 |
| 5,391,075 | 2/1995 | Robinson et al. | 431/350 |
| 5,409,167 | 4/1995 | Borod | 239/562 |
| 5,439,372 | 8/1995 | Duret et al. | 431/7 |
| 5,458,484 | 10/1995 | Ripka | 431/353 |

FOREIGN PATENT DOCUMENTS 61-265409 5/1985 Japan .

OTHER PUBLICATIONS

*Research to Develop Design Guidelines for Pre–Mixed Multi–Port (Meker) Burners*, Phase I Report (Jun. 1991–May 1992), Advanced Mechanical Technology, Inc. W.N. Skelley, et al.

*Primary Examiner*—Ira S. Lazarus
*Assistant Examiner*—Josiah C. Cocks
*Attorney, Agent, or Firm*—Pauley Petersen Kinne & Fejer

[57] ABSTRACT

A ported, premixed extendable burner provides increased turndown capability relative to conventional burners. The burner has an adjustable flameholder sleeve which can be extended and retracted relative to a flameholder, to increase and decrease the available flameholder area. The burner is suitable for use in modulated heating applications and other applications where high turndown ratios are desired.

22 Claims, 2 Drawing Sheets

PREMIXED IONIZATION MODULATED EXTENDABLE BURNER

FIELD OF THE INVENTION

This invention is directed to a gas burner having an adjustable firing surface area, which can operate over a wide range of firing rates while maintaining low levels of air pollutant emissions.

BACKGROUND OF THE INVENTION

The "turndown" ratio or capability of a burner is the ratio of its maximum firing rate to its minimum firing rate. Conventional ported premixed burners operating at fixed stoichiometry have a turndown capability of about 6:1. This ratio is generally governed by the flame speed of the particular fuel/air mixture, the flow velocity through the ports, the recirculation characteristics of the flow field immediately downstream from the ports, and the heat transfer characteristics of the system. If the relationship between these variables becomes out of balance, the result may be lifting or flashback. Upsets in the air/fuel ratio lead to increased emission of carbon monoxide, nitrous oxides, hydrocarbons, and other pollutants.

Burners are also employed in direct-fired make-up air furnace units. The burners are typically inserted into a make-up air duct or cabinet in a position upstream from an air blower. A portion of a make-up air stream is drawn into the burner(s) and enters a region where it is mixed with fuel injected through a manifold. The air/fuel ratio is chosen to minimize the emission of pollutants. The combustible mixture flows through a perforated plate which acts as a flame stabilizer. The hot combustion products then mix with bypass air, providing direct heat to the main air stream.

In order to increase the flexibility of premixed burners, to permit their operation over a wider range of temperatures and conditions, there is a need or desire for burners having higher turndown ratios that generate minimal quantities of pollutants.

SUMMARY OF THE INVENTION

The present invention is directed to an extendable premixed burner having a higher turndown capability while operating at fixed stoichiometry. The higher turndown capability is accomplished by providing the burner with a ported flameholder having an adjustable open area. By varying the area of the flameholder, the amount of heat generated can be increased or decreased to a greater extent than is possible using conventional burners having fixed flameholder areas. The burner can be used in furnaces, process heaters, turbine engines, and other appliances which employ premix or partially premix burners.

The burner of the invention includes a solid (i.e., non-perforated) outer housing tube having an inlet end and an outlet end. In a first embodiment, the outer housing tube may be movable with respect to a burner shroud. In this embodiment, the inner tube is fixed with respect to the outer housing tube. In a second embodiment, the position of the outer housing tube may be fixed with respect to the burner shroud. In this embodiment, an inner tube is movable back and forth with respect to the outer housing tube.

In both embodiments, the inner tube has a perforated section which serves as a ported flameholder, and which extends beyond the outlet end of the outer housing tube (for example, into a furnace or other appliance). The inner tube also has a solid (non-perforated) portion which does not extend beyond the outlet of the outer housing tube.

The spacing between the inner flameholder tube and the outer housing tube is sufficient to accommodate thermal expansion of the flameholder, yet insufficient to permit a flame to burn between the inner and outer tubes. In other words, the spacing between the tubes is small or substantially nonexistent. This way, the only area of the flameholder tube which may support a flame is on the part of the ported flameholder that extends beyond the outlet end of the outer tube. This area is adjustable by moving either the inner or outer tube relative to the other, to provide larger and smaller flames.

A gas injection manifold located inside the inner tube carries natural gas, or another combustible gas, from a supply source to a location upstream from the outlet of the outer tube and the exposed part of the ported flameholder. An air flow channel is located between the inner surface of the inner tube and the outer surface of the gas injection manifold. The air flow channel carries combustion air which mixes with the combustible gas leaving the gas injection manifold, at a desired predetermined ratio.

DETAILED DESCRIPTION OF THE PRESENTLY PREFERRED EMBODIMENTS

Figure 1:
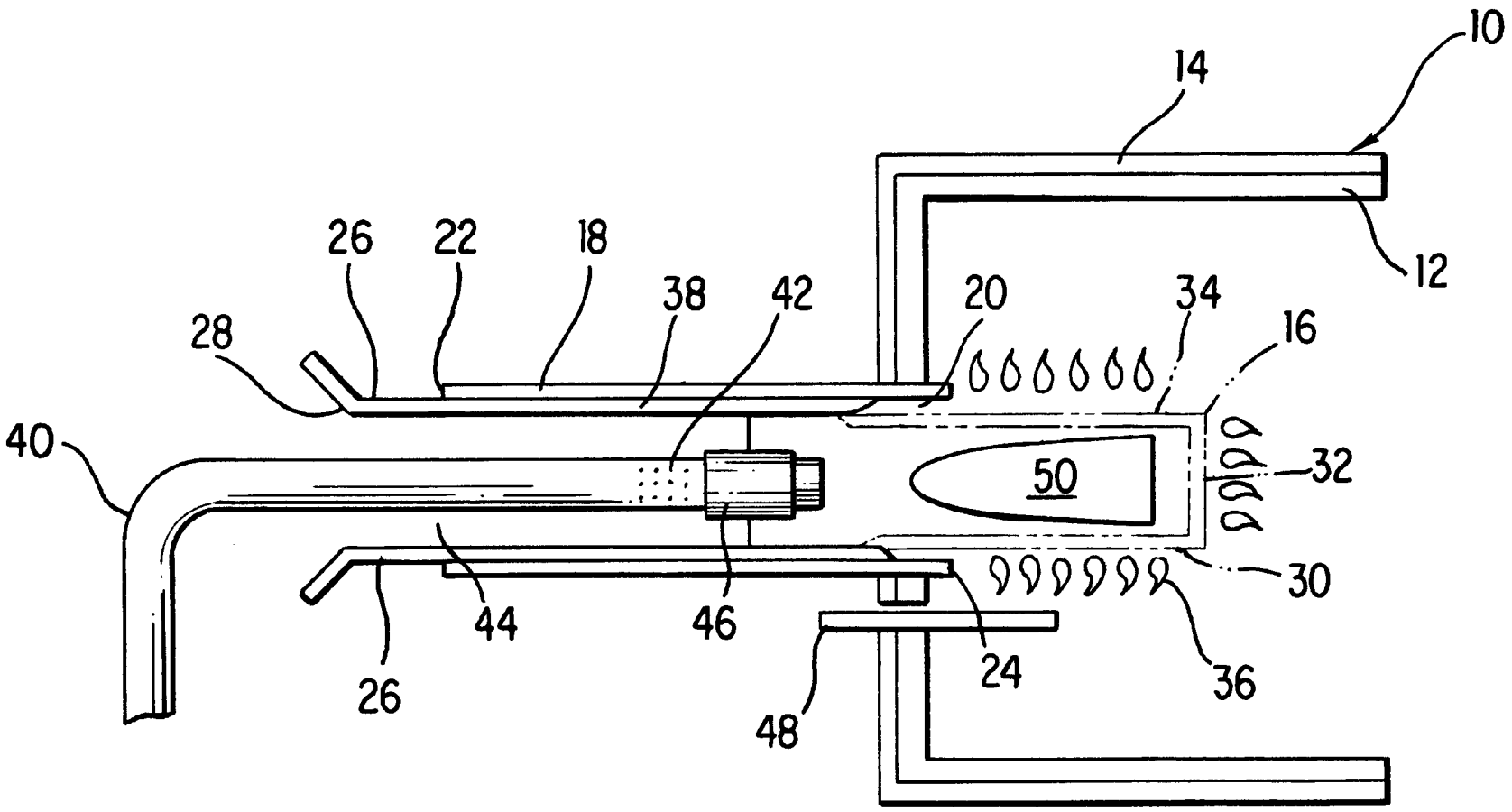
FIG. 1 schematically illustrates the extendable premixed burner of the invention, connected to a furnace housing.

Referring to FIG. 1, part of a shroud 10 is shown, having an insulation layer 12 and a housing 14. A flame is stabilized on the surface of an extendable premix burner 16 contained within the shroud 10. The premix burner 16 includes an outer housing duct 18 which is axially movable relative to a flameholder portion 30 and shroud housing 14. Outer duct 18 is preferably tubular, and mounted around an inner duct 26. The outer housing duct 18 has an inlet end 22 which is remote from opening 20, and an outlet end 24 which extends just inside opening 20. The outer housing duct 18 is constructed of a solid (i.e., non-perforated) material, which can be steel or a high temperature-resistant ceramic.

The burner 16 also includes an inner duct 26 which is preferably tubular, and which is fixed with respect to the shroud housing 14. The outer duct 18 may slidably engage the inner duct 26, or may rotatably engage the inner duct 26 via a threaded connection. If the inner and outer ducts slidably engage each other, the outer duct 18 may be pushed and pulled relative to the inner duct 26 by any suitable means, including without limitation the use of a plunger connected to a first end 22 of outer duct 18 and associated with a linear actuator. If the inner and outer ducts are rotatably engaged using a threaded connection (e.g., using threads on the outer surface of inner duct 26 and engaging complementary threads on the inner surface of outer duct 18), then the outer duct 18 may be driven forward and backward, and simultaneously rotated, using a gear and motor assembly or another suitable rotating mechanism.

The inner duct 26 includes a perforated flameholder portion 30 at a second end 32 thereof The flameholder portion 30 includes a plurality of small openings 34 on and around the outer surface of the duct. The openings 34 feed a flame 36 by carrying a combustible mixture of fuel gas and air from the inside of the duct 18, and outward through the openings 34. The fuel gas may be a hydrocarbon gas, another organic fuel gas, or an inorganic fuel gas such as hydrogen.

A presently preferred flameholder has a 8–15% open area, with openings about 0.01–0.05 inch in diameter. The open area may range from about 5–25% in different embodiments, with openings ranging from about 0.01–0.10 inch in diameter. Depending on the axial position of the outer duct 18 relative to the inner duct 26, the flameholder portion 30 of the inner duct may be substantially inside the outer duct, or substantially extending beyond the second end 24 of the outer duct into the shroud 10, or partly inside and partly extending beyond the outer duct.

Figure 2:
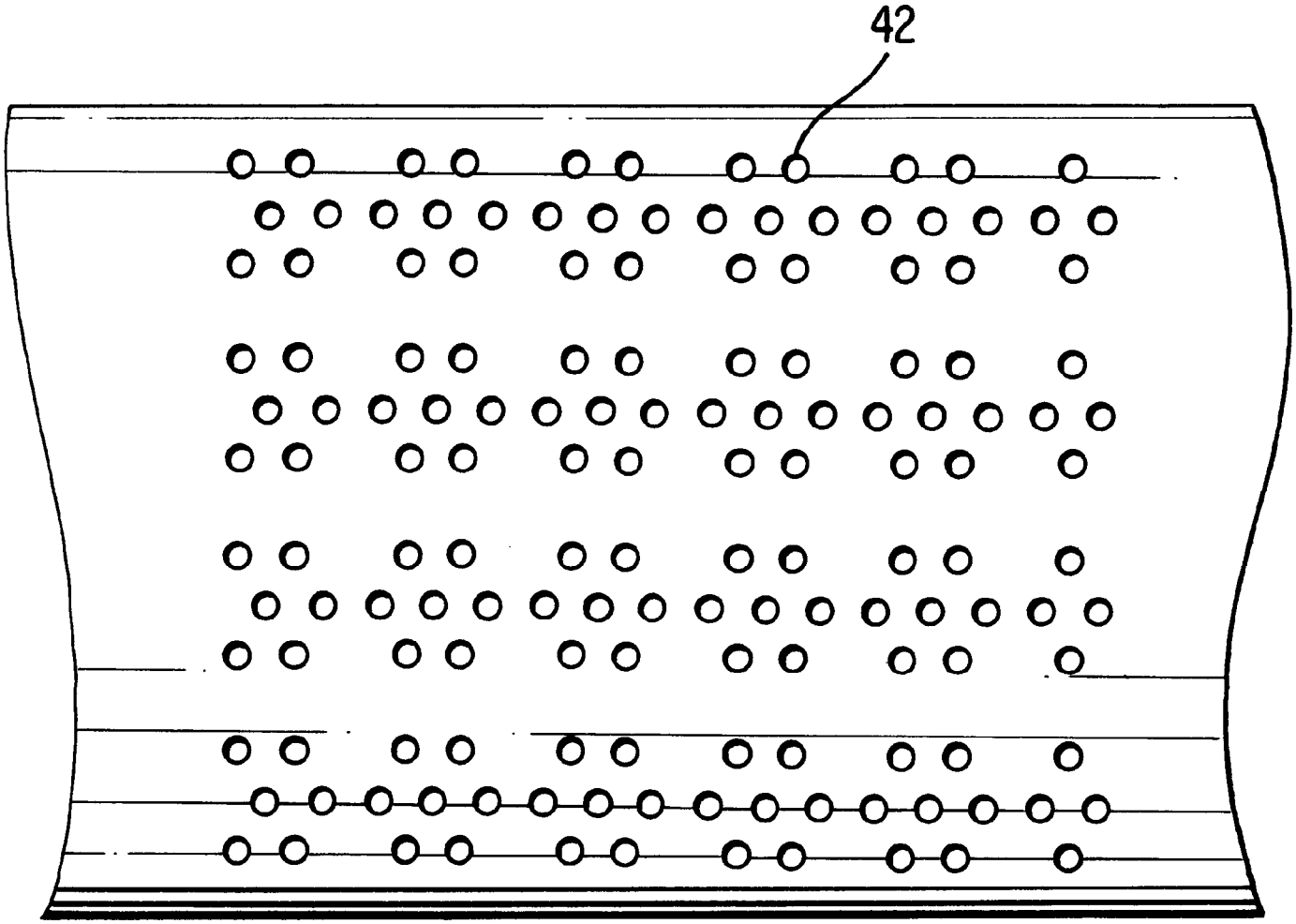
FIG. 2 illustrates a presently preferred pattern for port openings on the burner flameholder.

A preferred pattern of flameholder openings 34 is shown in FIG. 2. The flameholder openings are arranged in groups of up to seven openings as shown, each having a hole diameter of about 0.03 inch, to provide an overall flameholder open area of about 11%.

The flameholder 30 should have an outer diameter which is slightly smaller than the inner diameter of the outer duct 18. The difference between the outer diameter of flameholder portion 30 of duct 26, and the inner diameter of duct 18, should be large enough to accommodate any thermal expansion of the flameholder portion 30 without interfering with the movement of duct 18 relative to duct 26 and the flameholder. On the other hand, the difference between the two diameters must be small enough that when the flameholder 30 (or a portion thereof) is inside the outer duct, there is not enough space between the flameholder 30 and the outer duct to propagate a flame in the region surrounded by the outer duct. This way, the existence of a flame 36 is confined to the part of flameholder 30 that extends beyond the outer housing 18 and into the shroud. A gap on the order of 1 mm is presently preferred, for parts which are constructed of stainless steel.

The inner duct 26 also has a solid (non-perforated) tube section 38 at a first end 28 thereof. The solid duct section 38 may have an outer diameter nearly the same, or slightly smaller than the inner diameter of outer housing 18, so that the outer housing 18 either slidably engages the solid duct section 38, or rotatably engages the solid duct section 38 via a threaded connection (not shown).

As an alternative to the embodiment described above, burner 16 may be designed with outer duct 18 having a fixed position relative to shroud housing 14, and inner duct 26 movable (along with flameholder 30) relative to the outer duct 18. Either embodiment provides for a retracted or closed position where the flameholder 30 is substantially surrounded by the outer duct, and an extended or open position where the flameholder 30 is substantially outside of the outer duct.

Gaseous fuel, preferably natural gas, is injected into the inner duct 26 though a gas manifold 40, which extends into the center of the inner duct and has a plurality of gas injection ports 42 opening into the inner duct. Combustion air simultaneously enters the inner duct through channel 44, which is located between the inner surface of the inner duct 26 and the outer surface of gas manifold 40. The combustion air and hydrocarbon fuel are mixed in the portion of channel 44 surrounded by solid duct section 38 of the inner duct, before being fed to the flameholder portion 30. Preferably, the fuel equivalence (i.e., fuel/air) ratio of the mixture entering the inner duct will be about 0.7. A fuel/air ratio of 1.0 is defined as the stoichiometric balance which theoretically provides complete combustion of fuel in the air. In other words, at a ratio of 1.0 there is just enough oxygen in the air to completely consume all of the fuel. A ratio below 1.0 means there is an excess of air which, in practice, is needed to fully combust the fuel and minimize the level of pollutants emitted. The invention is not limited to any particular fuel/air ratio, and any suitable ratio may be utilized.

A manifold sleeve 46 is slidably mounted to the outer surface of manifold 40, and has the capability of sliding over, covering and blocking the fuel supply from some or all of the gas injection ports 42. For a given air flow velocity through duct channel 44, the burner 16 should be maintained at a constant ratio of fuel to air supply, in order to minimize pollutants. Therefore, as the fuel supply is varied by opening or closing some of the injection ports 42, the air supply entering the channel 44 should also be varied in tandem, and more or less flameholder openings 34 should be exposed to free passage of the fuel/air mixture. In a preferred embodiment, the sleeve 46 is mechanically linked to the movement of outer housing duct 18 (or flameholder 30, if movable) so that the number of open fuel holes 42 varies with the open flameholder area, providing the burner 16 with coarse control.

In one embodiment, a gas injection device may include a central gas supply pipe (not shown) connected to a plurality of gas injection manifolds 40, each manifold having a plurality of gas injection ports 42 and a manifold sleeve 46 as shown in FIG. 1. The manifolds may lead to a plurality of burners 16. The injection ports 42 are oriented and configured so that fuel gas is injected into the air stream at an angle of about 90 degrees relative to the flow of air. To further facilitate the axial flow of air into the flameholder portion 30, a parabolic-shaped insert 50 (FIG. 1) or similar effective device may be located inside the flameholder portion. The insert 50 helps to maintain a constant axial velocity of the fuel/air mixture at various axial portions inside flameholder 30. This helps to ensure a constant static pressure inside the flameholder, and a consistent gas flow rate through flameholder openings 34 at different axial positions.

The premix burner 16 may be operated at turndown ratios of up to about 25:1, and has much greater operating flexibility than conventional burners having a fixed flameholder area. A turndown ratio of about 4:1 can be achieved by varying the quantity (velocity) of fuel/combustion air mixture fed into the inner duct channel 44. A further turndown ratio of about 6:1 can be achieved by extending and retracting the outer duct 18 with respect to the flameholder portion 30 (or vice versa). A flame sensor 48, used to monitor the strength and heat of the flame 36, is mounted in the furnace 10 near the flame 36. Flame sensor 48 can be used to help determine the fuel/air ratio at any particular time, which is needed to provide clear combustion.

To use the burner system as a modulating device, the burner 16 may be programmed and controlled using techniques familiar to persons skilled in the art, to supply heat at different turndown ratios in a predetermined sequence. The outer duct 18 (or flameholder 30) may be automated so that it extends and retracts, in a programmed sequence. The supply of combustion fuel and air to the burner may also be modulated, to provide greater overall turndown ratios. In summary, the operation of the burner system may be modulated in much the same fashion as conventional furnaces, except with greater flexibility due to the ability to modulate the area of flameholder 30 that is used for combustion.

The shroud 10 may also be designed using multiple burners 16, arranged to operate in unison or in a predetermined sequence. If individual burners 16 are axially and rotatably moved using a drive gear and motor, the shroud 10 may be configured so that the gears mesh. Other conventional practices are also possible using the premix burner 16 of the invention, with the caveat being that the extendable/retractable burner 16 will always provide an otherwise conventional burner system with greater performance flexibility.

While the embodiments of the invention described herein are presently considered preferred, various modifications and improvements can be made without departing from the spirit and scope of the invention. The scope of the invention is indicated by the appended claims, and all changes that fall within the meaning and range of equivalency are intended to be embraced therein.

We claim:

1. A burner, comprising:

an outer duct having an inlet end and an outlet end, and a first diameter;

an inner duct having a second diameter smaller than the first diameter;

at least one of the inner and outer ducts movable with respect to the other between a first position where the inner duct is substantially retracted relative to the outlet end of the outer duct and a second position where the inner duct extends partially beyond the outlet end of the outer duct;

wherein the inner duct includes a ported flameholder which is substantially inside the outer duct when the movable duct is in the first position, defining a first flameholder area, and at least partially outside of the outer duct when the movable duct is in the second position, defining a second flameholder area;

a gas manifold having a plurality of gas injection ports, the gas manifold coaxially positioned within the inner duct, an outer surface of the gas manifold and an inner surface of the inner duct defining an air flow channel, wherein the gas injection ports are configured such that a fuel gas is injected into the air flow channel at an angle relative to a flow of air through the air flow channel; and the gas manifold having a manifold sleeve, the manifold sleeve in communication with at least one of the inner and outer ducts to vary a supply of the fuel gas to the burner as the flameholder area is varied.

2. The burner of claim 1, wherein the outer duct is movable axially and rotatably with respect to the inner duct.

3. The burner of claim 1, wherein the inner duct is movable axially and rotatably with respect to the outer duct.

4. The burner of claim 1, wherein the inner and outer ducts are in threaded engagement with each other.

5. The burner of claim 1, wherein the outer duct is movable axially with respect to the inner duct.

6. The burner of claim 1, wherein the inner duct is movable axially with respect to the outer duct.

7. The burner of claim 1, wherein at least a portion of the inner and outer ducts slidably engage each other.

8. The burner of claim 1, wherein the inner and outer ducts comprise tubes.

9. The burner of claim 1, wherein the ported flameholder has a flameholder area which increases when the inner duct is extended, and decreases when the inner duct is retracted, relative to the outer duct.

10. The burner of claim 1, wherein the gas injection ports open into the inner duct.

11. The burner of claim 10, wherein the manifold sleeve is slidably mounted to the outer surface of the gas manifold, the manifold sleeve is operable to open and close at least some of the gas injection ports.

12. A burner comprising:

a ported flameholder having a flameholder area;

an apparatus for increasing and decreasing the flameholder area during operation of the burner, the apparatus further comprising a gas manifold coaxially aligned within an inner duct, an outer surface of the gas manifold and an inner surface of the inner duct defining an air flow channel, wherein a fuel gas exits the gas manifold through a plurality of gas injection ports at an angle relative to a flow of air through the air flow channel;

the gas manifold having a manifold sleeve, the manifold sleeve communicating with the apparatus for increasing and decreasing flameholder area to vary a supply of the fuel gas to the burner as the flameholder area is varied; and an insert in the ported flameholder which facilitates consistent flow of a fuel gas/air mixture to different openings in the flameholder.

13. The burner of claim 12, wherein the ported flameholder comprises a tube section having a plurality of openings.

14. The burner of claim 13, wherein the tube section has an open area percentage of about 5–25.

15. The burner of claim 14, wherein the open area percentage is about 8–15.

16. The burner of claim 13, wherein the openings have diameters of about 0.01–0.10 inch.

17. The burner of claim 13, wherein the openings have diameters of about 0.01–0.05 inch.

18. An appliance for generating heat, comprising:

a burner including a ported flameholder having an adjustable flameholder area;

an insert in the ported flameholder which facilitates consistent flow of a fuel gas/air mixture to different openings in the flameholder;

an apparatus for increasing and decreasing the flameholder area to vary an amount of heat generated by the flameholder; and a gas manifold having a plurality of gas injection ports, the gas manifold coaxially positioned within the inner duct, an outer surface of the gas manifold and an inner surface of the inner duct defining an air flow channel, wherein the gas injection ports are configured such that a fuel gas is injected into the air flow channel at an angle relative to a flow of air through the air flow channel, the gas manifold having a manifold sleeve, the manifold sleeve communicating with the apparatus for increasing and decreasing flameholder area to vary a supply of the fuel gas to the burner as the flameholder area is varied.

19. The appliance of claim 18, wherein the burner is modulated to increase and decrease the flameholder area in a programmed fashion.

20. A burner comprising:

a ported flameholder having a flameholder area;

a parabolic-shaped insert in the ported flameholder which facilitates consistent flow of a fuel gas/air mixture to different openings in the flameholder;

an apparatus for increasing and decreasing the flameholder area during operation of the burner; and a gas manifold including a plurality of gas injection ports, and a manifold sleeve, engaging the gas manifold and moveable along the gas manifold to block some or all of the gas injection ports, the manifold sleeve communicating with the apparatus to vary a supply of the fuel gas to the burner as the flameholder area is varied, wherein the gas injection ports are configured such that a fuel gas is injected into the air flow channel at an angle relative to a flow of air through the air flow channel.

21. The burner of claim 1, wherein the fuel gas is injected into the air flow channel at an angle of about 90 degrees relative to a flow of air through the air flow channel.

22. The burner of claim 12, wherein the manifold sleeve engages the gas manifold and moves along the gas manifold to block some or all of the gas injection ports.

* * * * *